United States Patent [19]

Edwards

[11] 4,197,962

[45] Apr. 15, 1980

[54] PACKAGING CONTAINER

[75] Inventor: John R. Edwards, Hough Green, England

[73] Assignee: Lever Brothers Company, New York, N.Y.

[21] Appl. No.: 917,268

[22] Filed: Jun. 20, 1978

[30] Foreign Application Priority Data

Jun. 24, 1977 [GB] United Kingdom ..... 26568/77

[51] Int. Cl.[2] ..... B65D 5/58

[52] U.S. Cl. ..... 220/461; 229/3.1; 229/17 R; 229/37 R

[58] Field of Search ..... 220/462, 463, 416, 418, 220/461; 229/3.1, 33, 17 R, 37 R; 222/107; 206/45.33, 45.34

[56] References Cited

U.S. PATENT DOCUMENTS

| | | | |
|---|---|---|---|
| 2,177,918 | 10/1939 | Vogt et al. | 206/45.31 |
| 2,713,963 | 7/1955 | Andrews et al. | 229/33 |
| 3,021,043 | 2/1962 | Phin | 229/33 |
| 3,460,739 | 8/1969 | Asman | 229/17 G |

*Primary Examiner*—Allan N. Shoap

[57] ABSTRACT

A packaging container which can be liquid tight or hermetically sealed is formed from a flat blank comprising an outer member which can be formed into a tubular body with closure flaps at each end and a filling and dispensing aperture, and a flexible membrane fixed to the inside of the outer member along a continuous peripheral seal line. The membrane covers at least 50% of the body portion of the outer member in the widthwise direction and extends over uninterrupted flap portions adjacent the covered body portion and over the filling and dispensing aperture so that after erection in conventional manner filling causes the membrane to move away from the body portion covered in the flat blank.

6 Claims, 6 Drawing Figures

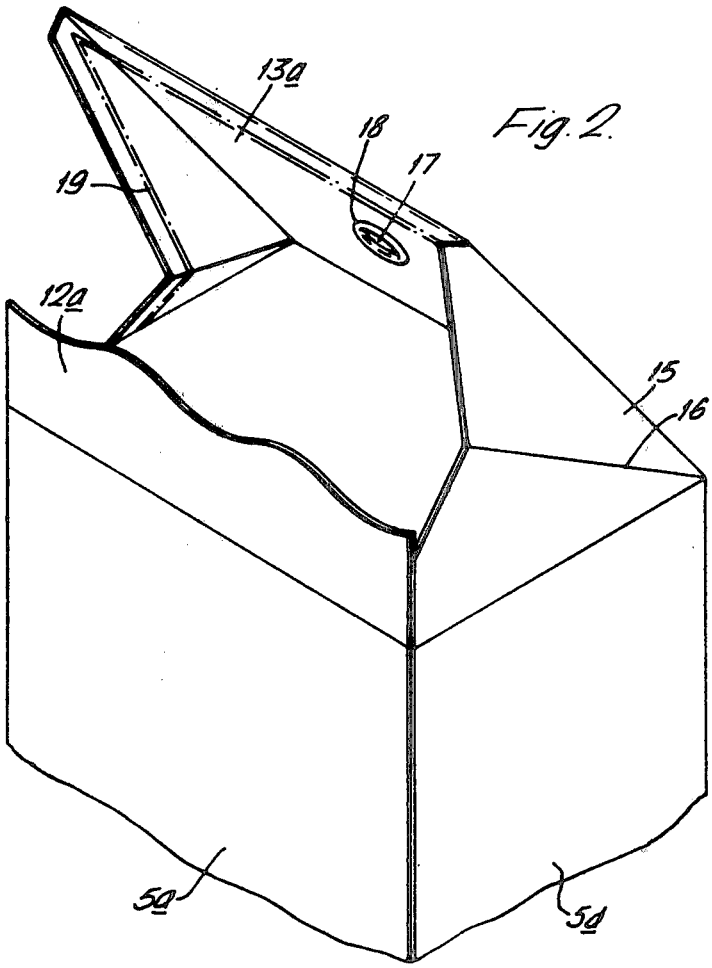
Fig. 2.
Fig. 6.
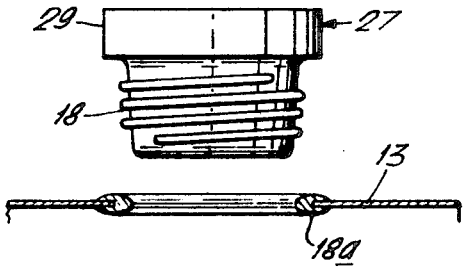

PACKAGING CONTAINER

This invention relates to packaging containers and particularly to packaging containers which can be folded from a flat blank to form a container which can be liquid tight or hermetically sealed.

It has been previously proposed to provide a packaging container having an outer of carton board and an inner receptacle consisting of a closed bag or envelope of flexible sheet material and a filling and dispensing device secured thereto, the inner receptacle and the outer carton being secured to another so that erection of the carton from the flat collapsed state automatically erects the inner receptacle. Such prior proposals necessitate the manufacture of the inner receptacle, the attachment of the filling and dispensing device thereto and the securing of the inner receptacle inside of the carton.

According to the present invention there is provided a flat blank for a packaging container comprising an outer member having a central body portion adapted to form a tubular body and flap portions at each end of the body portion connected to the body portion along first preformed fold lines, the flap portions being divided into closure flaps foldable to close the ends of the body portion, a flexible membrane attached to the outer member along a seal line extending around the entire periphery of the membrane, the flexible membrane covering at least 50% of the body portion between the seal lines in the widthwise direction of the body portion and extending over uninterrupted flap portions adjacent thereto and a filling and dispensing aperture in the outer member covered by the membrane. Such a flat blank can be readily manufactured in a minimum of operations and can be erected in the usual way to form a packaging container by first folding the body portion to form a tubular sleeve, joining together the two opposite longitudinal edges of the body portion and subsequently closing the closure flaps at each end of the body portion to close the sleeve. The container can then be filled through the filling and dispensing aperture, the contents being filled into the container moving the membrane away from the body portion which it covers in the flat blank and the contents being contained by a receptacle having walls formed partly by the flexible membrane and partly by the outer member. By providing that the membrane between the seal lines covers at least 50% of the width of the body portion of the outer member it is ensured that on filling the container the membrane can be displaced within the container to a position in which it is supported by the body portion of the outer member. This minimises the forces which have to be resisted by the membrane and by the sealing attachment of the membrane to the outer member and maximises the volume of the receptacle with respect to the overall size of the container.

There is thus provided a flat blank which is easily and cheaply made using a minimum amount of material and to a large extent on standard manufacturing equipment.

The choice of materials for the outer member and the membrane are governed by the contents to be contained. The flexible membrane is conveniently of plastics material which can be heat sealed to the outer member or a laminate of plastics materials, or a laminate having a layer of metallic foil, the laminates being heat sealable to the outer member. The outer member can advantageously comprise a liquid proof material such as a plastics material or a liquid proof carton board or a laminate of plastics material with carton board so that the container can be used for containing liquids.

The filling and dispensing aperture can be closed by any suitable means such as the application of a cover patch over the aperture or by the use of an openable closure device secured in the aperture of the outer member. When desired a rim sealing member can be provided around the filling and dispensing aperture to protect the cut edge of the outer member from the contents and/or to provide means for receiving the closure device.

The filling and dispensing aperture is preferably located in one of the closure flaps. This enables the container to be filled and opened at one end which will usually form the top of the container. A further closure flap can be provided which is foldable to overlie the aperture when the blank has been erected and the container has been filled. If this flap is secured in position after filling then the container is pilferproof.

The body portion can be provided with a number of second parallel fold lines transverse to the first fold lines joining the flap portions and the body portion, said second fold lines dividing the body portion into a plurality of body panels. The body portion is preferably divided into four body panels, the flexible membrane covering three of said body panels and their adjacent closure flap portions. The adjacent closure flap portions covered by the membrane can be divided into central closure flaps by a pair of parallel flap fold lines aligned with the second fold lines defining the central body panel of said three body panels, side closure flaps on each side of the central flap being provided with a diagonal fold line joining the intersection of the parallel flap fold lines with the first preformed fold lines.

The flexible membrane can be sealingly attached to the outer member along a transverse seal line transverse to said first preformed fold lines and extending between the peripheral seal line, filling and dispensing apertures being provided in the outer member on each side of said transverse seal line in that part of the outer member covered by the membrane. In this way the packaging container can be provided with two separate inner receptacles the contents of which are prevented from mixing with one another. When the seal line is disposed centrally of the membrane the two inner receptacles are of substantially identical volume.

The invention will now be more particularly described with reference to the accompanying diagrammatic drawings in which:

FIG. 2 is a perspective view showing a part of the flat blank of FIG. 1 partially erected into a container;

Figure 5:
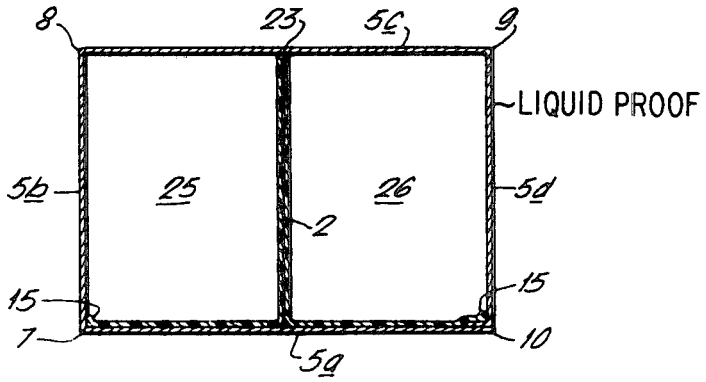
Figure 4:
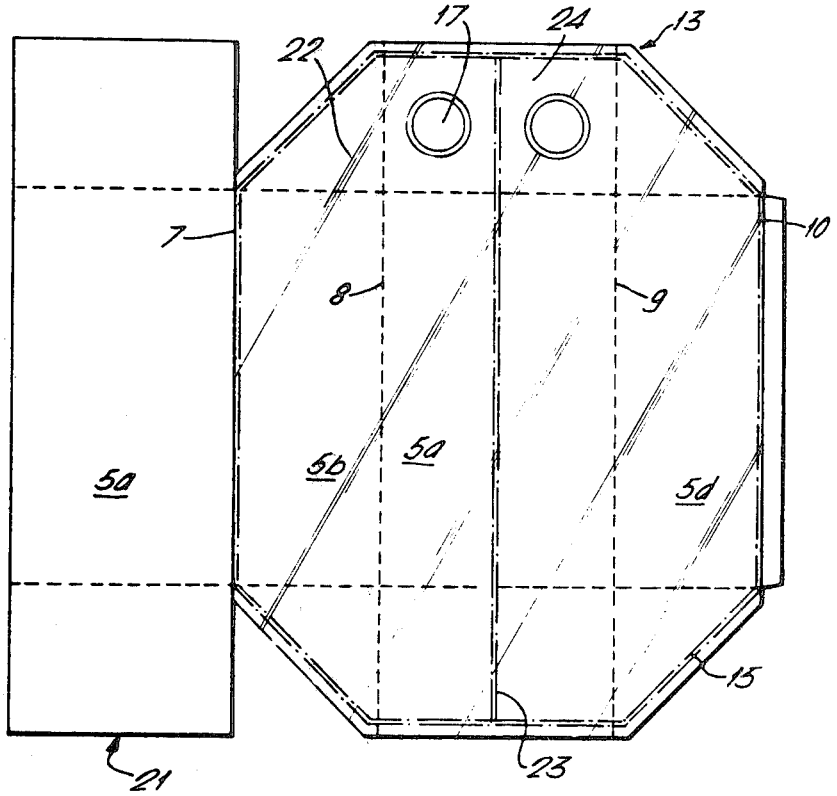
FIG. 4 is a plan view of another embodiment of a flat blank.

FIG. 5 if a cross-sectional plan view of a container erected from the blank of FIG. 4; and FIG. 6 shows one form of closure device.

Figure 1:
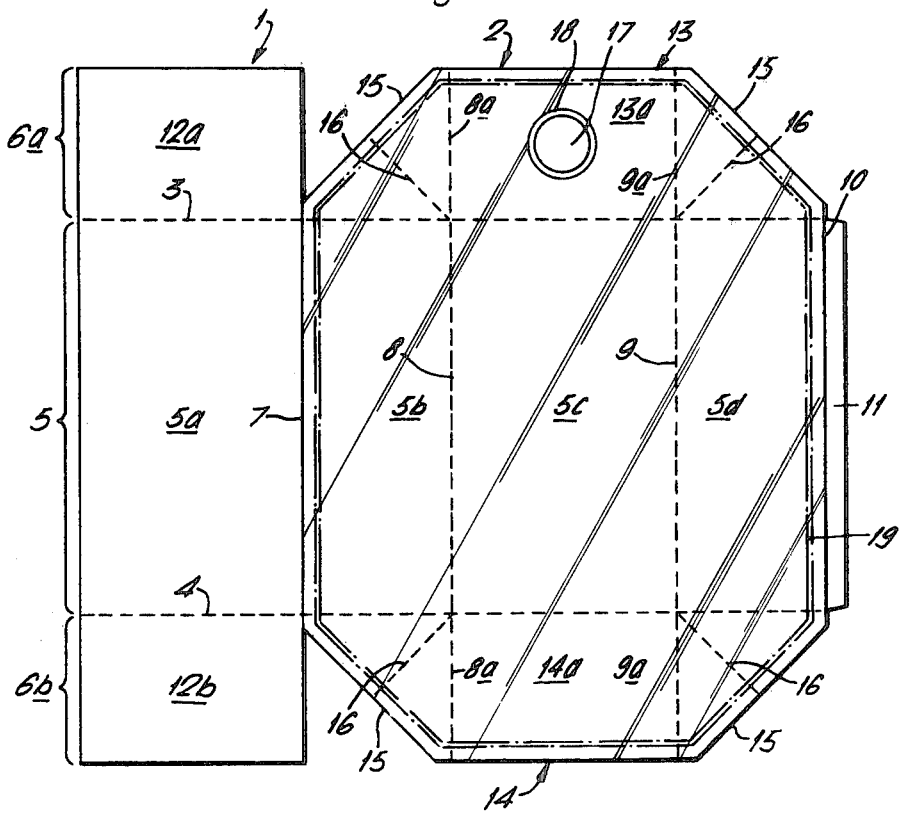
FIG. 1 is a plan view of a flat blank.

Referring to FIG. 1 there is shown a flat blank according to the present invention comprising an outer member 1 and a flexible membrane 2 indicated by the shaded area.

The outer member 1 is of folding boxboard having an extruded coating of polyethylene and is divided by first parallel fold lines 3 and 4 to form a body portion 5 therebetween and flap portions 6*a* and 6*b* connected to the body portion by these fold lines. The body portion is divided by second parallel fold lines 7, 8 and 9 extending transverse to the first fold lines into body panels 5*a*, 5*b*, 5*c* and 5*d* and a fold line 10 joins a longitudinal connecting flap 11 to the body panel 5*d*.

The flap portions 6*a* and 6*b* are each divided into an outer closure flap 12*a* and 12*b* respectively connected to body panel 5*a* and uninterrupted flaps 13 and 14 respectively connected to the body panels 5*b*, 5*c* and 5*d*. Flap fold lines 8*a* and 9*a* aligned with the second fold lines 8 and 9 extend across the flaps 13 and 14 to divide them into a central closure flap 13*a* and 14*a* respectively adjacent the body panel 5*c* and side closure flaps 15 on each side of the central flaps, each of the side closure flaps 15 being divided by diagonal fold lines 16 joining the intersection of the flap fold lines 8*a* and 9*a* with the first preformed fold lines 3 and 4.

The central closure flap 13*a* is provided with a filling and dispensing aperture 17 having a rim sealing member 18 secured therein to cover the cut edge of the outer member.

The flexible membrane 2 indicated by the shaded area of FIG. 1 is of flexible plastics material comprising a polypropylene/polyethylene heat sealable laminate and covers three body panels 5*b*, 5*c*, 5*d* and the adjacent closure flaps 13 and 14 including the dispensing aperture 17 in flap 13*a*. The membrane is heat sealed to the outer member along a continuous seal line 19 extending around the entire periphery of the membrane to secure the membrane and outer member together in a liquid tight manner.

Erection of the flat blank to a container is effected in the conventional manner of erecting cardboard blanks, the blank being first folded over along fold line 9 and along fold line 7, the connecting flap 11 being secured to the body panel 5*a* to join the body portion along its longitudinal edges.

The blank can then be "squared up" to form a tubular sleeve and the ends closed as indicated in FIG. 2 by folding in the side closure flaps 15 so they fold on the diagonal fold 16 as the central closure flaps 13*a* and 14*a* are folded down. At the bottom of the container the outer closure flap 12*b* can then be folded over and secured to the central flap 14*a* whilst at the top of the container the outer closure flap 12*a* (part of which is cut away in FIG. 2 for clarity) is left unsecured until after filling of the container and sealing of the aperture 17.

The contents being filled into the container move the flexible membrane away from the body panels covered in the flat blank. Thus the membrane is moved away from the body panel 5*c* towards the body panel 5*a* whilst being folded back on itself on the two body panels 5*b* and 5*d* to which it is secured as shown in FIG. 3.

Figure 3:
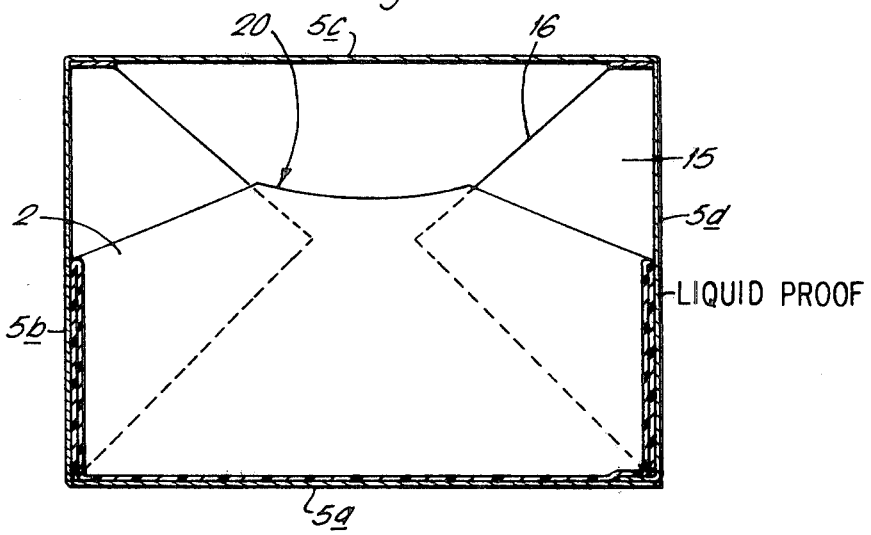
FIG. 3 is a cross-sectional plan view from above of an erected container showing the membrane in the filled position.

Because the membrane is only secured at its outer periphery to the closure flap portion the membrane at the bottom of the container, and also at the top of the container if it is completely filled, can conform to the inner shape of the outer member folding somewhat as indicated at 20 in FIG. 3. In the filled condition the membrane is therefore supported by the outer member.

It will be appreciated that for the flexible membrane to fold back and conform to the inner shape of the outer member it is necessary that, in the flat blank, the membrane between the seal lines covers at least 50% of the width of the body portion of the outer member. This ensures that sufficient membrane material is present in the body portion but depending upon the cross-sectional size of the body portion of the container and the relationship of this cross-sectional size with respect to the longitudinal length of the container, and the closure flap construction, it may be desirable to increase the width covered by the membrane above 50% to provide sufficient membrane material to allow it to conform to the end of the container. In the described embodiment, for example, the membrane is arranged to cover some 65% of the body width between the seal lines in the widthwise direction of the body portion.

After filling the container shown in the drawings the aperture 17 can be closed by adhering a closure patch (not shown) across the aperture and the closure flap 12*a* folded down and secured over the top of the container. Alternatively the outer closure flap 12*a* can be dimensioned so that it does not overlie the filling and dispensing aperture thereby allowing the flap to be secured in position before filling of the container.

The container has been described as of materials which form a liquid tight container. Other materials such as plastics or paperboard or metal foils or combinations of these materials may be chosen for containing both liquid and dry products or to resist gaseous pressure within the container. The container can also be hermetically sealed if desired.

In the embodiment shown in FIGS. 1 to 3 the rim sealing member 18 prevents liquid penetrating the cut edge of the outer member around the aperture 17. In an alternative construction the rim sealing member 18 can be designed to receive a closure device such as a screw top thereby facilitating the closure of the container after dispensing a proportion of the contents. In such a construction the outer closure flap 12*a* would be adapted to the particular closure device to allow the closure flap to be folded over the top of the container to retain the closure flap 13 in the correct position.

Referring now to FIG. 4 there is shown a flat blank similar to that shown in FIG. 1, like parts being referred to by the same reference numerals. The flexible membrane indicated by the shaded area 22 is secured to an outer member 21 along a seal line 15 as in FIG. 1 but the membrane is additionally sealingly attached to the outer member along a transverse sealing line 23 extending centrally of the body panel 5*c* between the seal line 15 in the flap portions. The central closure flap 24 in the flap portion 13 is provided with two filling and dispensing apertures 17.

After erection to form a container and filling, the membrane and outer member in this embodiment provide two separate inner receptacles 25 and 26 as shown in FIG. 5. By arranging the relevant portions of the seal line 15 to substantially coincide with the fold lines 7 and 10 there is sufficient membrane material for the membrane of both receptacles to conform to the body panel 5*a* in the erected container.

In an alternative construction the width of the outer member covered between the relevant portions of the seal line 15 may be less than the distance between the fold lines 7 and 10, the membrane being chosen to be sufficiently strong to resist the load imposed by the contents without requiring the full support of the outer member.

In a further alternative the width of the outer member covered between the sealing lines of the membrane in the widthwise direction can be increased, this alternative being in certain instances desirable to provide membrane material at the ends of the container, to maximise the volume of the receptacles with respect to the overall volume of the container as well as to benefit from the full support of the outer member.

In the embodiment of FIGS. 4 and 5 the transverse seal line 23 is disposed centrally of the membrane 2 so that the receptacles 25 and 26 are of substantially identical volume. Receptacles of unequal volume can of course be provided by offsetting the transverse seal line 23 from the central position.

Various forms of closure device can be used in conjunction with appropriate rim sealing members for closing a filling and dispensing aperture or apertures in the container. Such closures can be particularly convenient when it is desired to provide for reclosure of the container after dispensing part only of the contents. One such closure device 27 is shown in FIG. 6 in the form of a stopper and a screw threaded portion 28 and a head portion 29 which can be gripped to rotate the stopper. As shown in cross-section in FIG. 6 a rim sealing member 18*a* is secured in an aperture in a closure flap 13 of the outer member as before and is adapted to receive the stopper 27.

What is claimed is:

1. A flat blank for a packaging container comprising an outer member having a central body portion adapted to form a tubular body and flap portions at each end of the body portion connected to the body portion along first parallel fold lines, the flap portions being divided into closure flaps foldable to close the ends of the body portion, an uninterrupted flexible membrane attached to the outer member along a seal line extending without discontinuity around the entire periphery of the membrane, the flexible membrane covering at least 50% of the body portion between the seal lines and extending over uninterrupted integrally connected flap portions adjacent thereto and a filling and dispensing aperture in the outer member covered by the membrane, said body portion being provided with a number of second parallel fold lines which are transverse to the first parallel fold lines, said second parallel fold lines dividing the body portion into a plurality of body panels, said body portion being divided into four body panels each having closure flaps attached thereto at opposing ends, the flexible membrane covering three of said body panels and their adjacent closure flaps.

2. A blank according to claim 1 in which the adjacent closure flaps covered by the membrane are divided into central closure flaps by a pair of parallel flap fold lines aligned with the second fold lines defining the central body panel of said three body panels and side closure flaps on each side of the central flaps, said side closure flaps being provided with a diagonal fold line joining the intersection of the parallel flap fold lines and the first parallel fold lines.

3. A blank according to claim 1 in which the flexible membrane is sealingly attached to the outer member along a transverse seal line transverse to said first parallel fold lines, and extending between the peripheral seal line, filling and dispensing apertures being provided in the outer member on each side of said transverse seal line in that part of the outer member covered by the membrane.

4. A blank according to claim 3 in which the transverse seal line is disposed centrally of the membrane.

5. A blank according to claim 1 in which the flexible membrane is of plastics material which is heat sealed to the outer member.

6. A blank according to claim 5 in which the outer member comprises a liquid proof material.

* * * * *